United States Patent [19]

Hübel

[11] Patent Number: 4,540,934

[45] Date of Patent: Sep. 10, 1985

[54] DEVICE FOR THE FINE ADJUSTMENT OF THE OUTPUT VOLTAGE OF MULTI-PHASE REGULATING TRANSFORMERS

[75] Inventor: Egon Hübel, Feucht, Fed. Rep. of Germany

[73] Assignee: Schering Aktiengesellschaft, Berlin and Bergkamen, Fed. Rep. of Germany

[21] Appl. No.: 501,815

[22] Filed: Jun. 7, 1983

[30] Foreign Application Priority Data

Jun. 9, 1982 [DE] Fed. Rep. of Germany ..... 3222264

[51] Int. Cl.[3] ..... G05F 1/14

[52] U.S. Cl. ..... 323/341; 336/149; 323/361; 323/256

[58] Field of Search ..... 363/100; 323/340, 341, 323/361, 256; 336/10, 145, 146, 148, 149

[56] References Cited

U.S. PATENT DOCUMENTS

| | | | |
|---|---|---|---|
| 2,617,978 | 11/1952 | Matthews | 323/341 |
| 3,204,176 | 8/1965 | Wilson | 323/340 |
| 3,247,445 | 4/1966 | Vaughan | 363/100 |
| 3,254,291 | 5/1966 | Vaughan | 363/100 |
| 4,170,739 | 10/1979 | Frusztajer et al. | 363/100 |
| 4,189,672 | 2/1980 | Peschel | 323/329 |
| 4,330,818 | 5/1982 | Peschel | 323/340 |

*Primary Examiner*—William H. Beha, Jr.
*Assistant Examiner*—Jeffrey Sterrett
*Attorney, Agent, or Firm*—Michael J. Striker

[57] ABSTRACT

A multi-phase regulating transformer is disclosed having a plurality of windings cooperating with stepping trolleys which are driven by a common driving member. To obtain fine adjustment of the output voltage, the trolleys are coupled to the driving member with different plays to introduce a dead travel of the driving member relative to at least one trolley, which exceeds the spacing between two adjoining individual windings of the transformer.

4 Claims, 5 Drawing Figures

FIG. 1
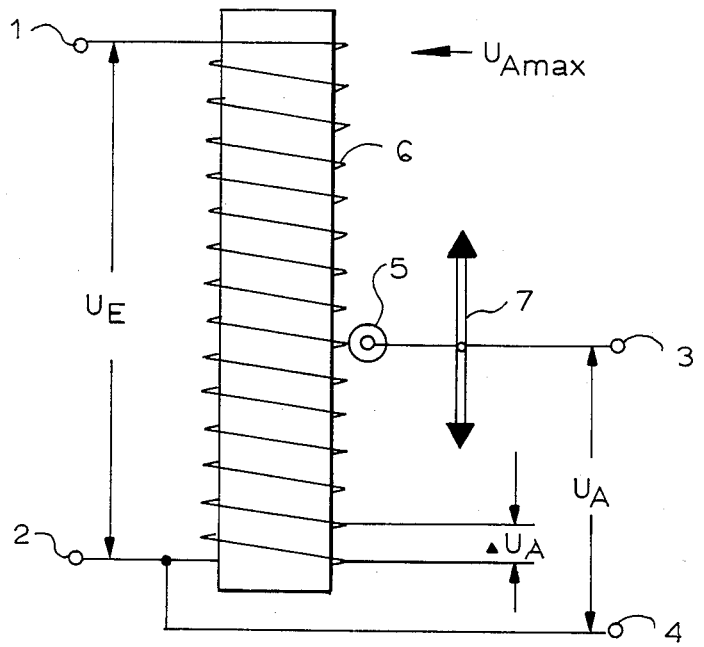
PRIOR ART
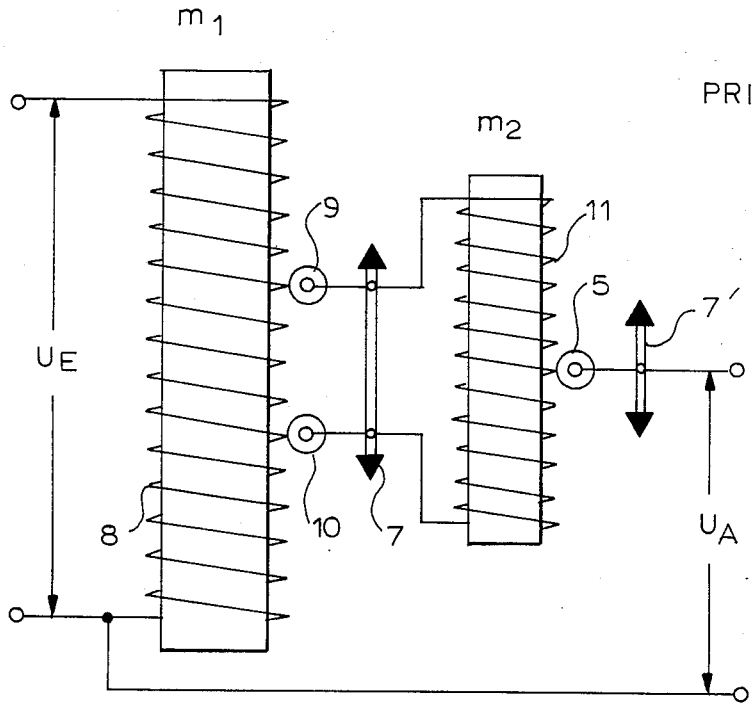
PRIOR ART
FIG. 2

DEVICE FOR THE FINE ADJUSTMENT OF THE OUTPUT VOLTAGE OF MULTI-PHASE REGULATING TRANSFORMERS

BACKGROUND OF THE INVENTION

The present invention relates in general to multi-phase regulating transformers and in particular to a method of and a device for fine adjustment of the output voltage of such transformers. The invention is particularly suitable for use in electroplating installations.

As known, the output voltage of regulating transformers is adjustable within a certain range only, determined by structural limitations of the transformer. The adjustment is effected either manually or by means of an electromotive drive.

In many applications it is of importance that the output voltage be adjusted very accurately. In conventional transformers, however, the best achievable voltage resolution is that of one winding. That means that, if a regulating transformer has n windings at its tapping side, then the optimum resolution corresponding to the smallest obtainable output voltage increment $\Delta U_A$ $$\Delta U_A = U_A max/n$$

In multi-phase regulating transformers, such as three-phase transformers, the three regulating transformers are conventionally arranged in such a manner that the three voltages are tapped by means of a common drive. Usually, the setting trolleys of the three individual transformers when connected in a star configuration, are coupled together by means of a common axle or in the case of a delta configuration by means of a chain drive. The coupling means are designed in such a manner as to provide for a rigid coupling between the trolleys and the common axis or chain drive, thus ensuring synchronous movement in all three phases. This rigid coupling of the phases and the synchronization of the movement of tapping means result in the aforementioned limit of voltage resolution of the multi-phase regulating transformer.

It is true that methods and devices have already been devised which provide a better resolution of output voltages adjusted by a multi-phase regulating transformer than that determined by the adjustment range of a single winding voltage.

For example an arrangement is known in which a regulating transformer $m_1$ has two taps at its output. A voltage $\Delta U_{A1}$ between the two taps feeds a second regulating transformer $m_2$ which increases the resolution of the first mentioned transformer $m_1$ proportionally to the number of its windings. The two transformers must be constructed for withstanding the full current.

In another prior-art solution, there are employed electronic or electromagnetic regulating members instead of a regulating transformer. These regulating members make it possible to achieve a very good voltage resolution.

Also known is a method which relatively improves the resolution of regulating transformers. With this method if, at a given input voltage $U_E$ there is produced the desired output voltage $U_A$ already at a small number of windings $n_1$, then the resolution of voltage steps $\Delta U_{A1}=$ $$\Delta U_{A1} = U_{A1}/n_1$$

If however the desired output voltage $U_A$ is achievable at a larger number of windings $n_1$ only, then the resolution in comparison with windings $n_1$ is correspondingly larger ($n_2 > n_1$). Consequently, the regulation should take place in the end range of the transformer winding n. In practice, there are implied correspondingly accurately dimensioned and/or switchable transformers in series before or after the windings of the regulating transformer.

All these prior-art devices or methods, however, are possessed of the large disadvantage that they are complicated in structure and expensive. In addition, the construction of these known devices is not so strong and problem-free as in the construction of simpler multi-phase regulating transformers.

SUMMARY OF THE INVENTION

It is therefore a general object of the present invention to overcome the aforementioned disadvantages.

More particularly, it is an object of the invention to provide an improved multi-phase regulating transformer of the above described kind in which a substantial improvement of the voltage resolution is achieved by simple technological means.

An additional object of the invention is to provide such an improved regulating transformer which is easy to use and which requires a very simple maintenance.

In keeping with these objects and others which will become apparent hereafter, one feature of the invention resides, in a multi-phase regulating transformer having a plurality of windings and trolleys in contact with the windings and a common trolley driving member, in the provision of coupling means between at least one trolley and the driving member which has a different play than the remaining coupling means.

In the preferred embodiments of this invention, in connection with a three-phase regulating transformer, one trolley is coupled without play and the remaining second and third trolleys are actuated by the driving member only after a certain dead travel; or two of the trolleys are coupled without play and the third trolley is actuated after a dead travel; or the dead travels of the trolleys relative to the driving means are different for each trolley.

The dead travels can be predetermined in design and remain without change, or they may be made adjustable. In another modification, all trolleys can be coupled to the driving means by means of staggered rigid couplings or by couplings having adjustable backlash or play. When the multi-phase regulating transformer of this invention is used in connection with an electroplating installation having a rectifier connected to the output of the transformer, then a capacitor is provided at the rectified output voltage so as to smooth the ripple resulting from the differences in the play of the contact trolleys.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 shows schematically a single-phase prior-art transformer which can be used as a component part of a multi-phase transformer;

FIG. 2 is a circuit diagram of a prior-art arrangement for increasing the resolution of the tapped off voltage at the transformer of FIG. 1;

DESCRIPTION OF THE PREFERRED EMBODIMENTS

Figure 3:
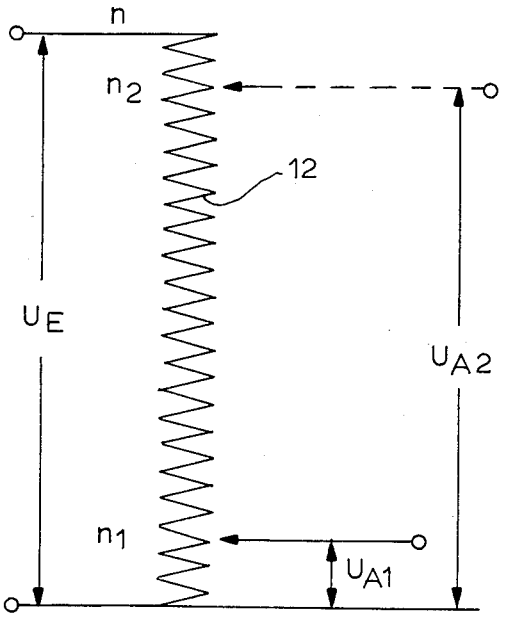
PRIOR ART FIG. 3
FIG. 3 shows schematically a known method for improving the resolution of a regulating transformer.

Referring firstly to known constructions of single-phase regulating transformers, FIG. 1 shows schematically a single-phase variable-ratio transformer which can be a component part of a multi-phase regulating transformer. At the end terminals 1 and 2 of a winding 6, an input voltage $U_E$ is applied. The output voltage $U_A$ at terminals 3 and 4 is regulated by moving, either by hand or by means of an electromotive drive indicated schematically by arrow 7, a trolley 5 in contact with the individual windings 6 between the input terminals 1 and 2. The smallest output voltage increment $\Delta U_A$ which can be tapped off by the trolley 5 is determined by the displacement of the latter between two adjoining windings.

FIG. 2 depicts a known technical solution for improving the resolution of the adjustable output voltage. A first regulating transformer $m_1$ with winding 8 has two trolleys 9 and 10 spaced apart frome each other by a fixed distance and driven simultaneously by drive 7. The voltage difference $\Delta U_{A1}$ between the two trolleys 9 and 10 feeds the winding 11 of a second regulating transformer $m_2$ provided with an additional trolley driven by a separate driving member 7'. The second transformer increases the resolution of the output voltage from the first transformer proportionally to the number of windings 11. Both transformers $m_1$ and $m_2$ must be dimensioned for withstanding the full current load, and each of the two regulating transformers requires its own drive for adjusting the course range and the fine range of the output voltage.

A relatively better resolution of the output voltage has been obtained by a prior-art arrangement depicted in FIG. 3. According to this arrangement, the regulating transformer has a winding 12 which has adjustable end ranges and a fixed ratio intermediate range. The adjustment of the output voltage takes place in the end portions of the winding 12. As has already been explained, a relatively better resolution is achievable than in the case when the adjustment range is in the proximity of the beginning the winding.

Figure 4:
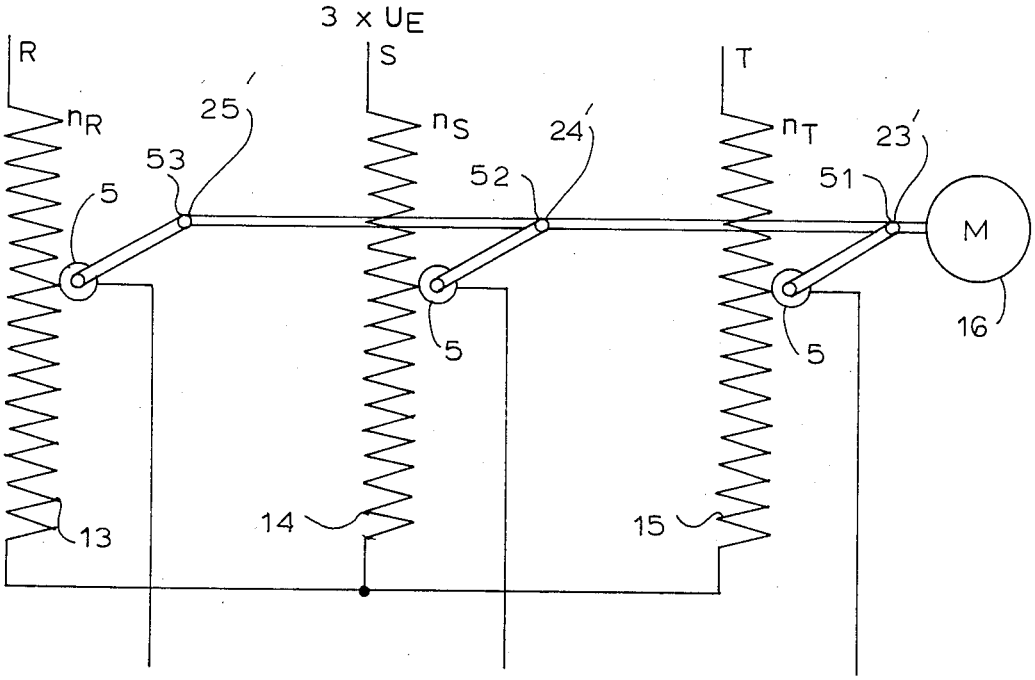
FIG. 4 illustrates schematically an arrangement of a three-phase regulating transformer for carrying out the method of this invention.

A method according to this invention for regulating output voltage $U_A$ of a three-phase transformer having three coils 13–15 with windings $n_R$, $n_S$ and $n_T$ is schematically illustrated in FIG. 4. Each of the three coils 13–15 is part of a single-phase regulating transformers which transforms voltage in the same manner as the remaining ones.

According to this invention, the prior-art rigid coupling between the common drive 17 and the tapping trolleys 5 is replaced by loose couplings 23' to 25' which intentionally introduce a limited asynchronization between the movements of the driving shaft 17 and the associated trolleys 5.

A common electric motor drive 16 moves a common displacement member 17 which, depending on the connection of the coils of the multi-phase transformer, can be either a shaft or a chain drive. Due to the different play in respective couplings 23'–25', the individual trolleys 5 are displaced only after a different amount of dead travel of the shaft 17 resulting from the different adjustment of the backlash in the couplings. As a result, the movements of the trolleys 5 along the windings 13–15 are out of synchronization, and this asynchronous movement enables a substantially finer voltage adjustment than the prior-art rigid couplings.

At a limit point of the displacement in a given direction of the driving shaft 17, the differences in play in the couplings are neutralized, and the voltage adjustment proceeds with the same resolution as in the case of rigid couplings. If however the direction of movement of shaft 17 is reversed, then the misalignment of the trolleys is reintroduced in the opposite direction until the limit of the maximum backlash is reached.

By selecting the magnitude of the play or backlash at individual trolleys, it can be determined how the combined output voltage of the multi-phase transformer will change in response to the displacement of the driving member, or in response to a setting angle of the driving motor 16. For instance, if only one trolley is moved immediately with the displacement of the driving shaft 17, then the output voltage resolution is three times finer than the resolution achievable with the simultaneous displacement of all three pulleys. In this manner, the resolution of the multi-phase regulating transformer is tripled without the necessity of any substantial reconstruction of the transformer.

A voltage ripple introduced by the asymmetry of the contact of respective trolleys due to their different play is compensated in a rectifying device, and for all practical purposes such as for example in electroplating installations, can be ignored.

If desired, the rectifying device, when the electroplating installation operates at a lower current range, the ripple can be removed in conventional manner by suitably dimensioned filtering capacitor connected in parallel to the rectified output voltage.

As known, in the lower current range, the asymmetries introduced by the differences in parameters of the individual transformers and in rectifying diodes are larger than the asymmetry introduced by the differences in the backlash of coupling means for the rolleys. At higher currents, the effect of asymmetry on the current ripple is negligible.

In the design of a three-phase regulating transformer according to this invention, the play in respective three phases is adjusted in a staggered fashion. For instance, a partial (single-phase) transformer has a trolley coupling S1 with no play, the second transformer has a certain play S2, and the third transformer has a coupling with largest play S3. In the case when the multi-phase regulating transformer is a part of a critical regulating circuit, it is of advantage when the number of individual windings swept by the trolley is adjustable in the range of the introduced play of the trolley coupling.

If data regarding the resolution of a particular trolley-winding combination are available, the play in the trolley coupling can be fixed according to these data.

EXAMPLE

Each partial regulating transformer has n windings. It is desired to produce a resolution of the output voltage relative to half a winding. In this case, couplings of two partial transformers are designed without play, whereas the coupling pertaining to the third trolley has a play of at least three windings.

In closed regulating circuits it is advantageous to select a staggered play in individual couplings, such as for example:

Phase R: Play=0 windings

Phase S: Play=$n_s$ windings

Phase T: Play=$2n_s$ windings

With increasing play, the fineness of voltage adjustment in the regulating circuit is facilitated, inasmuch as the coarse voltage adjustment does not occur so frequently. The asymmetry of the output voltage in respective phases, however, is also correspondingly increased.

The most favorable dimensioning of the multi-phase regulating transformer is achieved when, in the course of adjustment toward higher voltages, the desired value is overridden only once. After the reversal of the adjustment, the accurate value is set by the trolley with no play in cooperation with the trolley with the smaller play.

Figure 5:
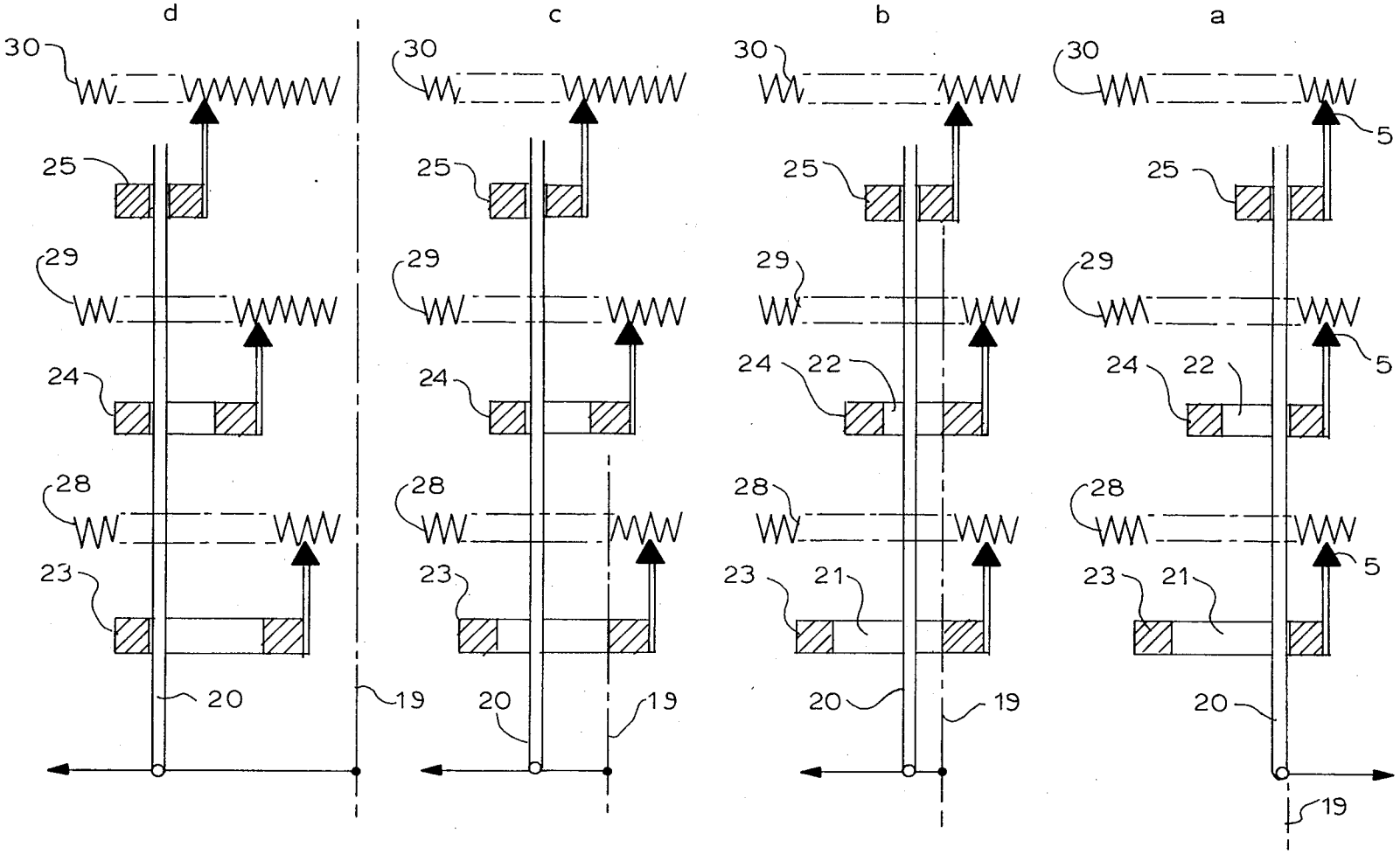
FIG. 5 shows in sectional side views different modifications of a multi-phase regulating transformer according to this invention.

This relationship is depicted in FIG. 5, illustrating a linear displacement of the trolleys. The same conditions, however, are valid also for an angular displacement.

In FIG. 5, reference numeral 19 indicates the starting position of a linear driving member 20 for trolleys 5. Coupling elements 23–25 for respective trolleys 5 are designed with a different play; namely, the coupling element 25 has zero play, whereas coupling elements 23 and 24 have different plays 21 and 22. Due to these differences, when the shaft 20 is moved to the left as indicated by arrows, the trolleys 5 are activated at different time intervals, thus introducing within the limits of the maximum play 21 an asynchronous movement of the trolleys and hence a certain amount of scatter in the contact points of the trolleys with the corresponding windings 28–30. It will be seen from FIG. 5*b* that at the initial minute displacement of the driving shaft 20 to the left, it is only a single-phase winding 30 with a tapping trolley without play which introduces any voltage change.

During the subsequent displacement of the driving shaft in the same direction to the left, at the limit of the smaller backlash or play 22 in the coupling element 24 is reached and at this moment the voltage adjustment is effective at two phases 29 and 30, whereas the lowermost phase 28 is still without any voltage change (FIG. 5*c*). Only after reaching the limit of the largest play 21 (FIG. 5*d*), are all three trolleys 5 displaced along the corresponding windings in synchronism.

After the reversal of the movement of the setting drive 20, the above described asymmetry in the engagement of coupling elements with the driving shaft is repeated in the same order but from different direction until the starting position shown in FIG. 5*a* is reached, where all three trolleys 5 are in alignment with one another. The arrows in FIGS. 5*b*–5*d* are directed to lower values of the tapped-off output voltages $U_A$, whereas the arrow in FIG. 5*a* is oriented toward the higher voltages.

Depending on the application, it may be desirable to align the trolleys 5 during their movement toward lower voltage values while misaligning them during the movement toward higher voltage values. In the case of an application in an electroplating device, it is advantageous when the lower adjustment range of the regulating transformer retains a starting voltage to overcome the forward-direction voltage, and therefore a zero position of the regulating transformer is never needed. In other words, in such applications, when moving in the direction towards the lowermost voltages, the asymmetry for the fine adjustment is no longer needed.

In the event that it is desired to adjust a zero output voltage, it is still possible to override the leading trolleys pertaining to couplings 24 and 25 past the end of the windings 29 and 30 and to adjust the zero voltage at the last winding 28.

It will be understood that each of the elements described above, or two or more together, may also find a useful application in other types of constructions differing from the types described above.

While the invention has been illustrated and described as embodied in a multi-phase regulating transformer for use in electroplating, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for fine adjustment of output voltage of a three-phase regulating transformer having a plurality of windings cooperating with assigned trolleys and common driving means for the trolleys, comprising coupling elements between respective trolleys and the driving means, said coupling elements having different play to introduce a dead travel exceeding the spacing between adjoining windings, of the driving means relative to at least one of the trolleys, and wherein one of the coupling elements has zero play and the second and the third coupling element have different plays to introduce different dead travels.

2. A device as defined in claim 1, wherein two coupling elements are without play and a third coupling element has a play for introducing the dead travel.

3. A device as defined in claim 1, wherein the play in at least one coupling element is fixed.

4. A device as defined in claim 1, wherein the plays of respective coupling elements are fixedly staggered.

* * * * *